US008794296B2

(12) United States Patent
Shih et al.

(10) Patent No.: US 8,794,296 B2
(45) Date of Patent: Aug. 5, 2014

(54) WINDOW BLIND WITHOUT USING A LIFT CORD

(75) Inventors: Chin-Chang Shih, Lugang Township, Changhua County (TW); Yang-Hsin Shih, Lungang Township, Changhua County (TW)

(73) Assignee: Taiwan Bamboo Curtain Enterprise Co. Ltd., Changhua (TW)

( * ) Notice: Subject to any disclaimer, the term of this patent is extended or adjusted under 35 U.S.C. 154(b) by 202 days.

(21) Appl. No.: 13/433,419

(22) Filed: Mar. 29, 2012

(65) Prior Publication Data

US 2013/0255891 A1 Oct. 3, 2013

(51) Int. Cl.
*E06B 9/36* (2006.01)

(52) U.S. Cl.
USPC ..... 160/168.1 R; 160/84.06; 160/173 R

(58) Field of Classification Search
CPC ..... E06B 9/24; E06B 9/262; E06B 9/264; E06B 9/32; E06B 9/326; E06B 9/327; E06B 9/388; E06B 9/56; E06B 9/68
USPC ..... 160/170, 171, 168.1 R, 172 R, 173 R, 160/84.06
See application file for complete search history.

(56) References Cited

U.S. PATENT DOCUMENTS 4,212,341 A * 7/1980 Fisher ..... 160/84.04
5,477,904 A * 12/1995 Yang ..... 160/370.23
5,813,447 A * 9/1998 Lysyj ..... 160/84.04
6,029,734 A * 2/2000 Wang et al. ..... 160/170
6,644,372 B2 * 11/2003 Judkins ..... 160/84.04
6,644,373 B2 * 11/2003 Palmer ..... 160/168.1 R
6,675,861 B2 * 1/2004 Palmer et al. ..... 160/170
7,117,919 B2 * 10/2006 Judkins ..... 160/170
7,487,817 B2 2/2009 Liang
2002/0088562 A1 * 7/2002 Palmer ..... 160/170
2007/0023151 A1 * 2/2007 Judkins ..... 160/170
2007/0151676 A1 * 7/2007 Lin ..... 160/170
2008/0099159 A1 * 5/2008 Nien ..... 160/170
2013/0240166 A1 * 9/2013 Shih et al. ..... 160/349.1

* cited by examiner

*Primary Examiner* — Katherine Mitchell
*Assistant Examiner* — Abe Massad
(74) *Attorney, Agent, or Firm* — Che-Yang Chen; Law Office of Michael Chen

(57) ABSTRACT

A window blind includes a retractable shading unit, a headrail connected with an upper end of the shading unit, a bottom rail connected with a lower end of the shading unit, at least one connecting cord extended through the shading unit and having a first end secured on the headrail and a second end secured on the bottom rail, a plurality of limit members mounted in the bottom rail, and a control unit mounted on the bottom rail. The second end of the connecting cord is provided with an elastic section having a length that is changed elastically to correspond to an expansion length of the shading unit. Thus, the elastic section of the connecting cord is extended or loosened when the shading unit is expanded or retracted to prevent from producing noise during movement of the shading unit.

6 Claims, 10 Drawing Sheets

WINDOW BLIND WITHOUT USING A LIFT CORD

BACKGROUND OF THE INVENTION

1. Field of the Invention

The present invention relates to a window covering and, more particularly, to a window blind that is expandable downward and retractable upward in a vertical direction without needing a lift cord.

2. Description of the Related Art

A conventional window covering, such as a Venetian blind, roman shade and the like, usually comprises a lift cord to expand or fold the window covering. However, the lift cord depends from a side of the window covering so that the lift cord is easily tangled with a child's neck, thereby causing danger to the child. In addition, the lift cord protrudes outwardly from the window covering, thereby decreasing the aesthetic quality of the window covering.

A conventional window blind without a lift cord comprises a retractable shading member, a headrail connected with the upper end of the shading member, a bottom rail connected with the lower end of the shading member. The headrail has a receiving recess which has a bottom provided with a plurality of cord holes. A cord winding controller and a fixing seat are mounted on two opposite sides of the receiving recess of the headrail. A movable seat is movably mounted in the receiving recess of the headrail and is disposed between the cord winding controller and the fixing seat. At least one connecting cord is extended through the cord holes of the headrail and the shading member and is secured on the bottom rail. Each of the fixing seat and the movable seat is provided with a plurality of guide members for winding and guiding movement of the connecting cord. The cord winding controller has an interior provided with a rotation disk and a torsion spring. The cord winding controller is provided with a driving cord which is connected with the movable seat. The driving cord links the connecting cord on the fixing seat and the movable seat. Thus, when the bottom rail is pushed upward or pulled downward, the connecting cord is loosened or tightened to drive the driving cord so as fold or expand the shading member. Thus, the connecting cord and the driving cord form a balanced state so that the user can expand or fold the shading member easily. However, the conventional window blind without a lift cord has a complicated construction and cannot be repaired easily and conveniently, thereby increasing the cost of fabrication and maintenance. In addition, the conventional window blind is not assembled easily and quickly. Further, the shading member is expanded and folded by driving of the movable seat and the cord winding controller, thereby easily producing noise during operation the movable seat and the cord winding controller. Further, when the driving cord is scrolled or unscrolled by the cord winding controller, the cord winding controller easily produces noise due to operation of the rotation disk and the torsion spring in the cord winding controller.

The closest prior art reference of which the applicant is aware was disclosed in U.S. Pat. No. 7,487,817.

BRIEF SUMMARY OF THE INVENTION

In accordance with the present invention, there is provided a window blind, comprising a retractable shading unit, a headrail connected with an upper end of the shading unit, a bottom rail connected with a lower end of the shading unit, at least one connecting cord extended through the shading unit and having a first end secured on the headrail and a second end secured on the bottom rail, a plurality of limit members mounted in the bottom rail, and a control unit mounted on the bottom rail. The headrail has a side provided with a first opening and has an interior provided with a first track. The bottom rail has a side provided with a second opening and has an interior provided with a second track. The shading unit includes a plurality of shading members located between the headrail and the bottom rail. Each of the shading members of the shading unit has a surface provided with a plurality of through holes. The connecting cord is in turn extended through the headrail, the through holes of each of the shading members, the bottom rail and the control unit, and is wound around between the limit members. The second end of the connecting cord is provided with an elastic section. The elastic section of the connecting cord has a length that is changed elastically to correspond to an expansion length of the shading unit.

According to the primary advantage of the present invention, the window blind comprises the headrail, the bottom rail, the shading unit, the connecting cord and the control unit so that the window blind has a simplified construction, thereby decreasing the cost of fabrication.

According to another advantage of the present invention, the window blind is assembled easily and quickly to facilitate a user assembling the window blind.

According to a further advantage of the present invention, a user only needs to press the push button so as to release the connecting cord and to release the push button so as to position the connecting cord so that the window blind is locked and unlocked easily and quickly.

According to a further advantage of the present invention, the elastic section of the connecting cord is extended or loosened when the shading unit is expanded or retracted to prevent from producing noise during movement of the shading unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
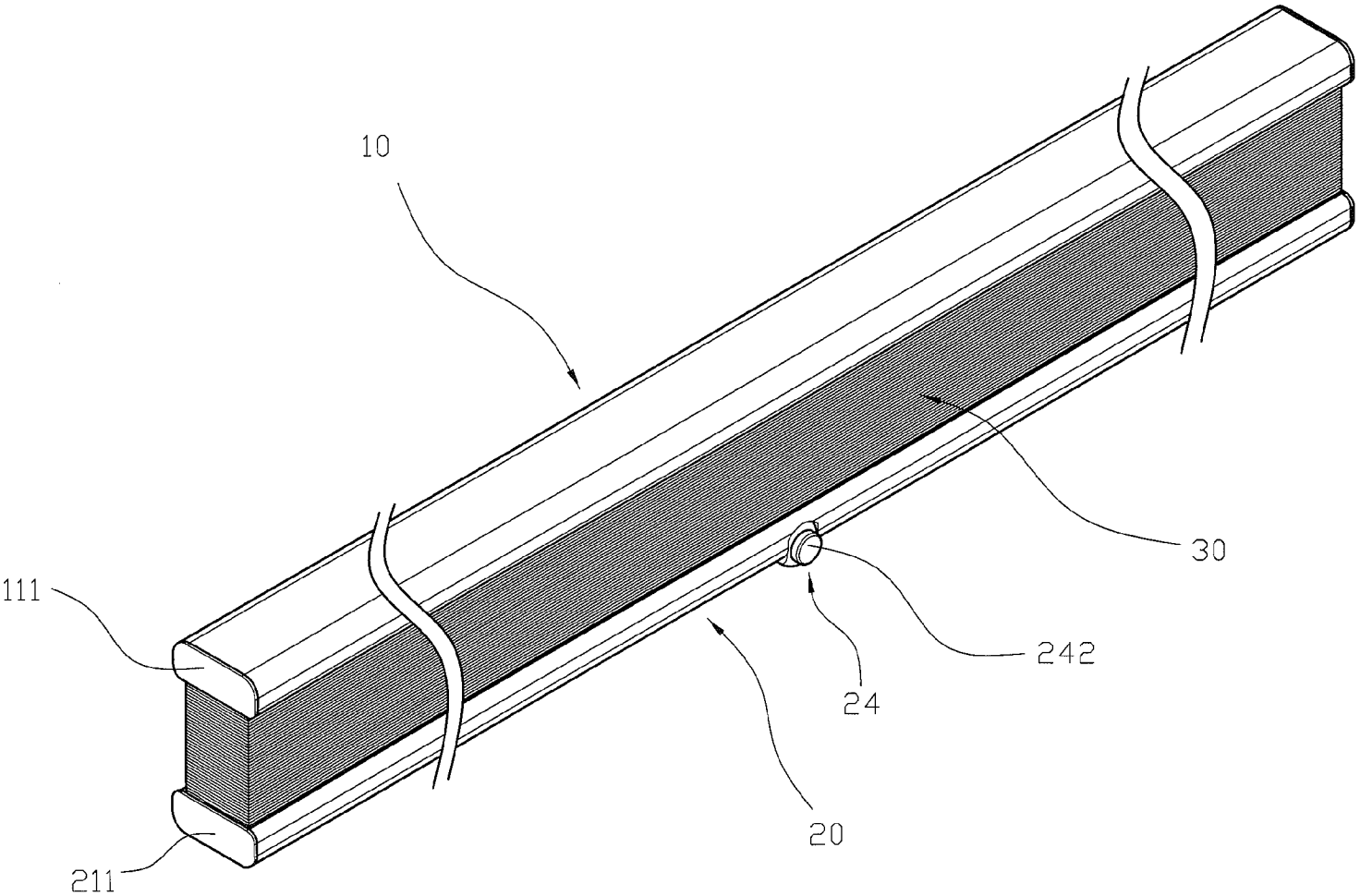
FIG. 1 is a perspective view of a window blind in accordance with the preferred embodiment of the present invention.
Figure 2:
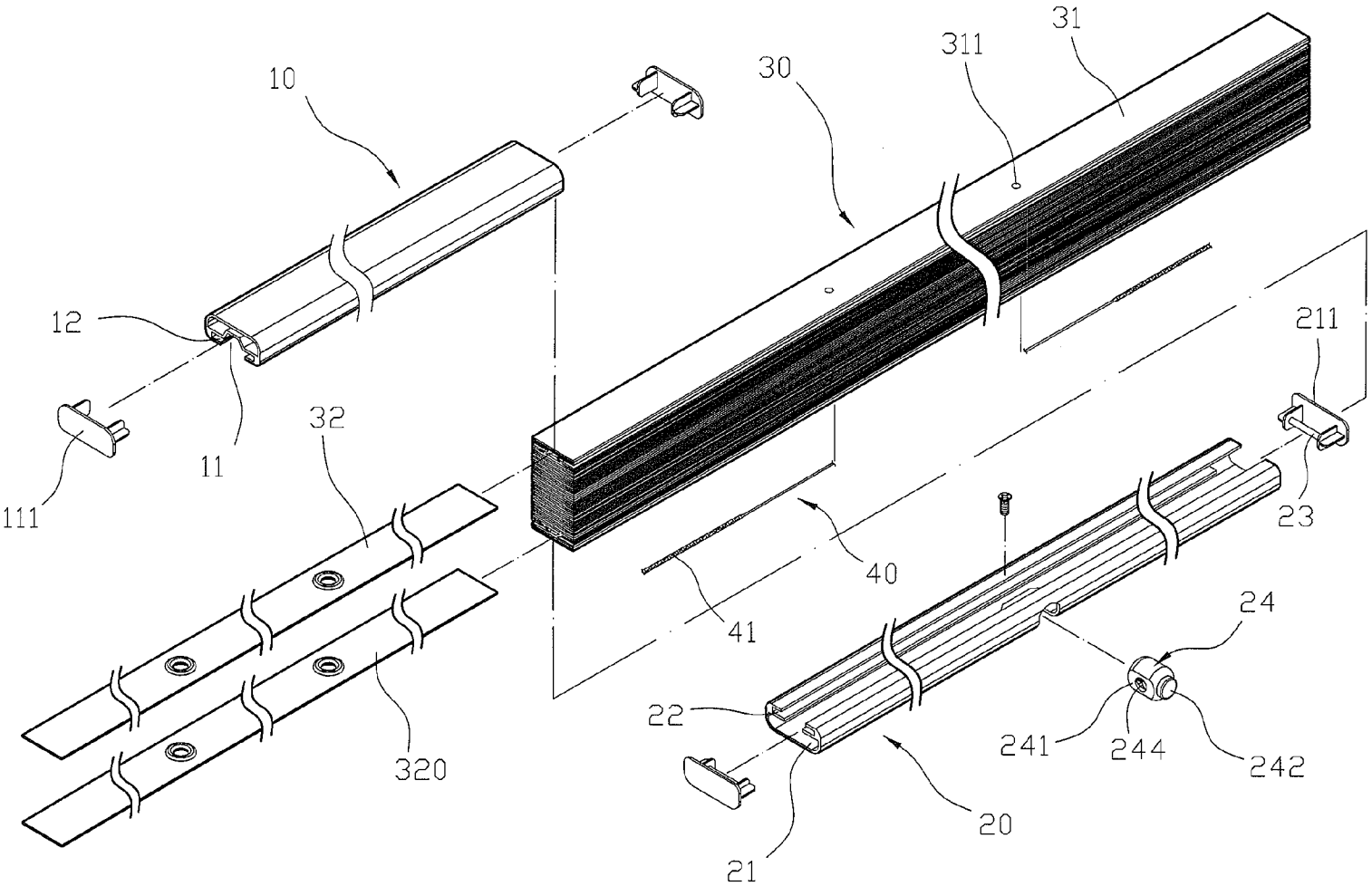
FIG. 2 is an exploded perspective view of the window blind as shown in FIG. 1.
Figure 3:
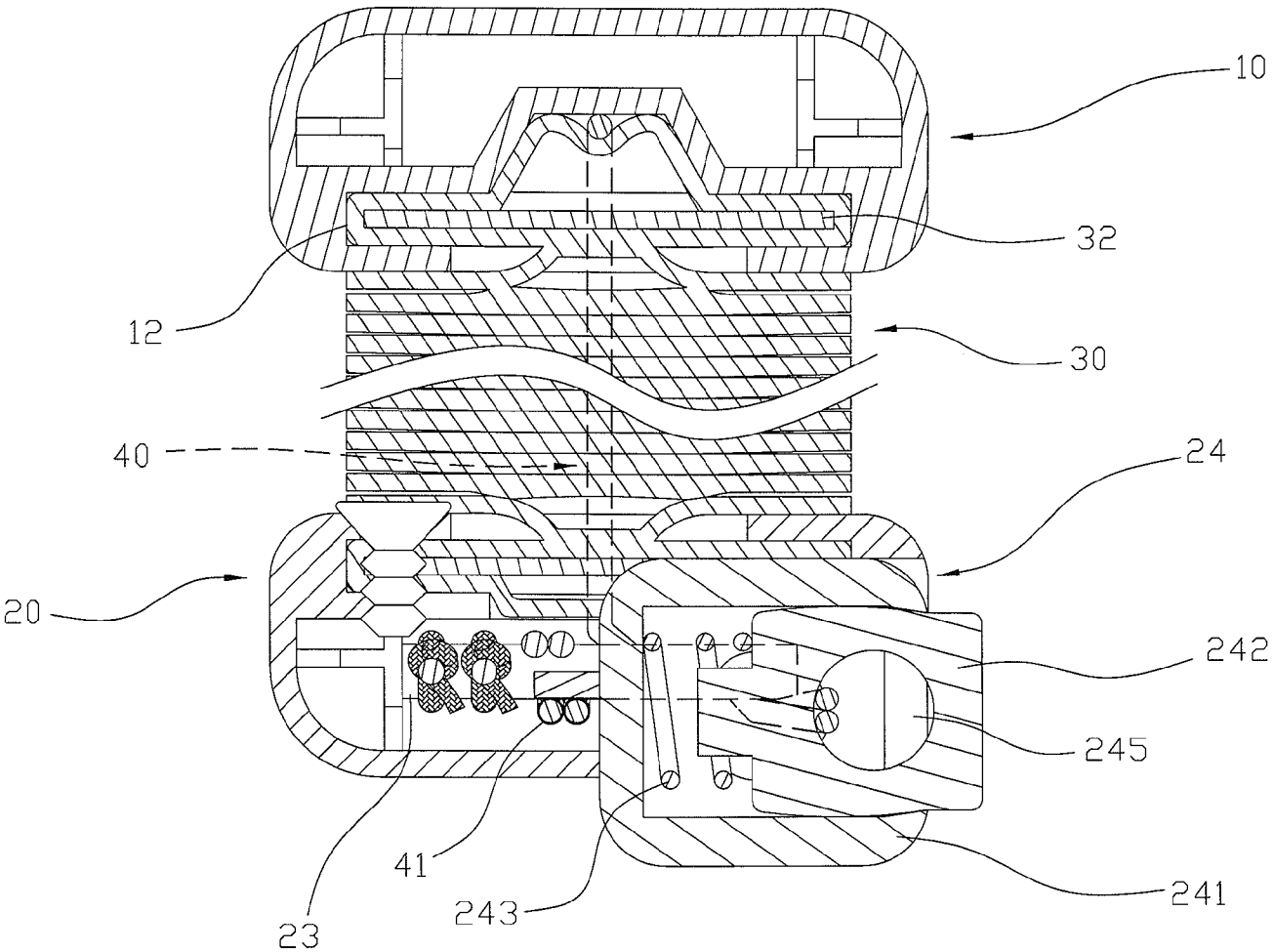
FIG. 3 is a side cross-sectional view of the window blind as shown in FIG. 1.

Referring to the drawings and initially to FIGS. 1-5, a window blind in accordance with the preferred embodiment of the present invention comprises a retractable shading unit 30, a headrail 10 connected with an upper end of the shading unit 30, a bottom rail 20 connected with a lower end of the shading unit 30, at least one connecting cord 40 extended through the shading unit 30 and having a first end secured on the headrail 10 and a second end secured on the bottom rail 20, a plurality of limit members 23 mounted in the bottom rail 20, and a control unit 24 mounted on the bottom rail 20.

The headrail 10 has a side provided with a first opening 11 and has an interior provided with a first track 12. The headrail 10 has two opposite ends each provided with a first end cap 111 to seal the first opening 11.

The bottom rail 20 has a side provided with a second opening 21 and has an interior provided with a second track 22. The bottom rail 20 has two opposite ends each provided with a second end cap 211 to seal the second opening 21. The second end cap 211 of the bottom rail 20 is combined with one of the limit members 23 integrally.

The shading unit 30 includes a plurality of shading members 31 located between the headrail 10 and the bottom rail 20. Each of the shading members 31 of the shading unit 30 has a surface provided with a plurality of through holes 311. The shading unit 30 further includes a first connecting plate 32 mounted on a top one of the shading members 31 and a second connecting plate 320 mounted on a bottom one of the shading members 31. The first connecting plate 32 of the shading unit 30 is mounted in the first track 12 of the headrail 10. The second connecting plate 320 of the shading unit 30 is mounted in the second track 22 of the bottom rail 20.

The connecting cord 40 is in turn extended through the headrail 10, the through holes 311 of each of the shading members 31, the bottom rail 20 and the control unit 24, and is wound around between the limit members 23. The second end of the connecting cord 40 is provided with an elastic section 41 which has a distal portion secured on one of the limit members 23. The elastic section 41 of the connecting cord 40 has a length that is changed elastically to correspond to an expansion length of the shading unit 30.

The control unit 24 includes a housing 241 secured in the bottom rail 20, a push button 242 movably mounted on the housing 241, and an elastic member 243 mounted in the housing 241 and biased between the housing 241 and the push button 242.

The housing 241 of the control unit 24 has a surface provided with a first passage 244 to allow passage of the connecting cord 40. The push button 242 of the control unit 24 has a first end received in the housing 241 and a second end protruding outward from the housing 241. The push button 242 of the control unit 24 has a surface provided with a second passage 245 to allow passage of the connecting cord 40. The second passage 245 of the push button 242 is connected to the first passage 244 of the housing 241. The elastic member 243 of the control unit 24 is biased between the housing 241 and the first end of the push button 242 to push the push button 242 outward relative to the housing 241. The connecting cord 40 is in turn extended through the first passage 244 of the housing 241 and the second passage 245 of the push button 242. The push button 242 of the control unit 24 is pushed outward from the housing 241 by an elastic force of the elastic member 243, and the connecting cord 40 is clamped between the housing 241 and the push button 242 so that the connecting cord 40 is positioned by the housing 241 and the push button 242 at a normal state.

In assembly, the connecting cord 40 is secured on the headrail 10. Then, the connecting cord 40 is in turn extended through the through holes 311 of each of the shading members 31 into the second opening 21 of the bottom rail 20. Then, the connecting cord 40 is wound around between the limit members 23, and the elastic section 41 of the connecting cord 40 is secured on one of the limit members 23. At this time, the connecting cord 40 is also extended through the first passage 244 of the housing 241 and the second passage 245 of the push button 242 when the connecting cord 40 is wound around between the limit members 23. In such a manner, the push button 242 of the control unit 24 is pushed outward from the housing 241 by the elastic force of the elastic member 243, and the connecting cord 40 is clamped between the housing 241 and the push button 242 so that the connecting cord 40 is positioned by the housing 241 and the push button 242 at a normal state as shown in FIG. 4.

Figure 4:
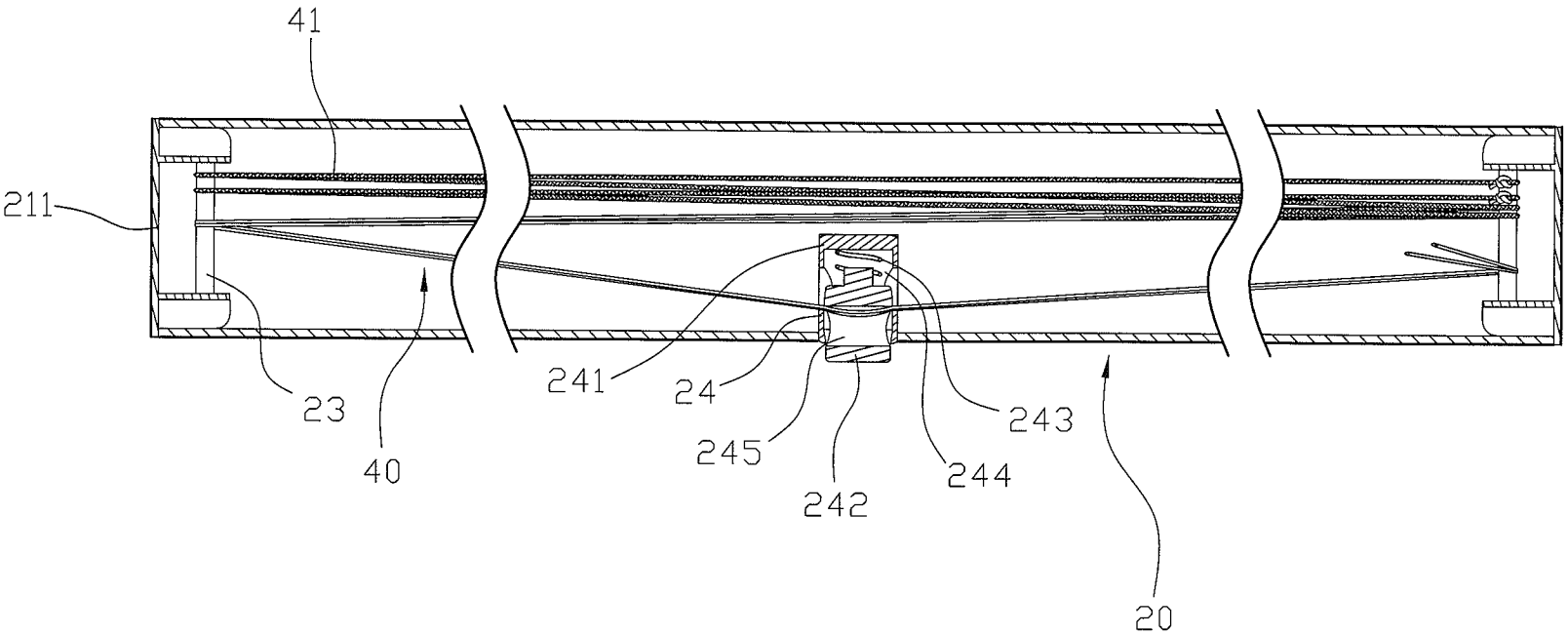
FIG. 4 is a top cross-sectional view of the window blind as shown in FIG. 1.
Figure 5:
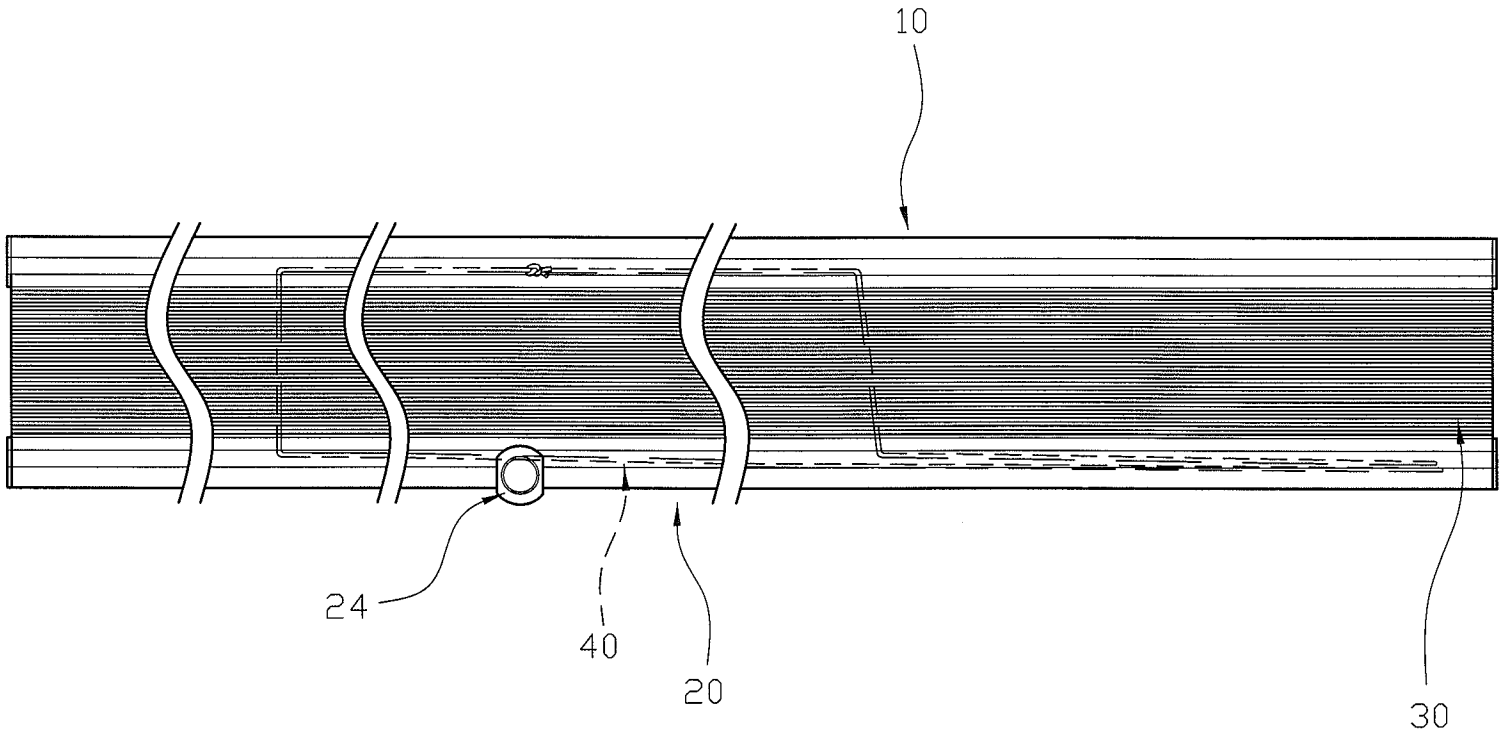
FIG. 5 is a front view of the window blind as shown in FIG. 1.
Figure 6:
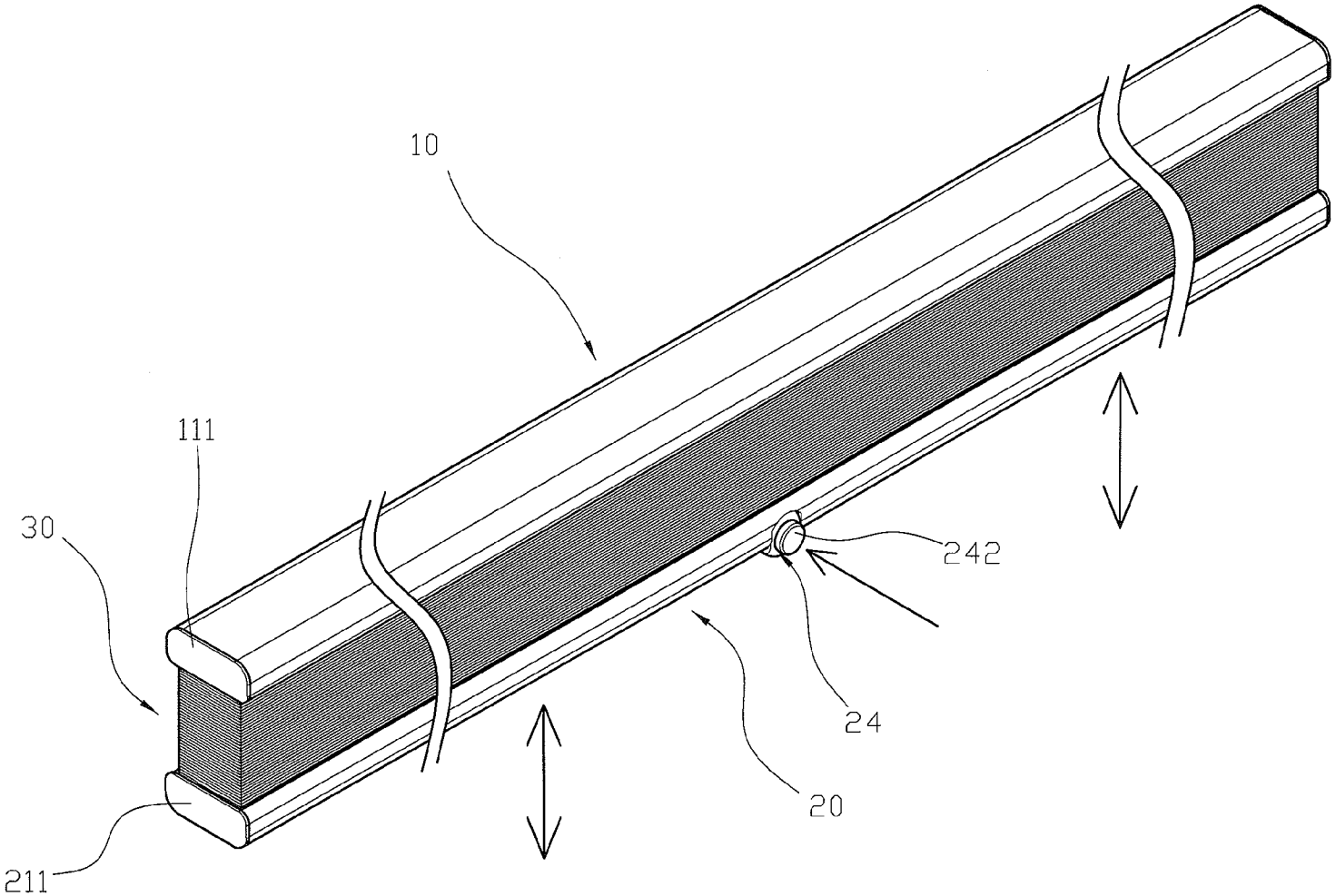
FIG. 6 is a schematic operational view of the window blind as shown in FIG. 1.
Figure 7:
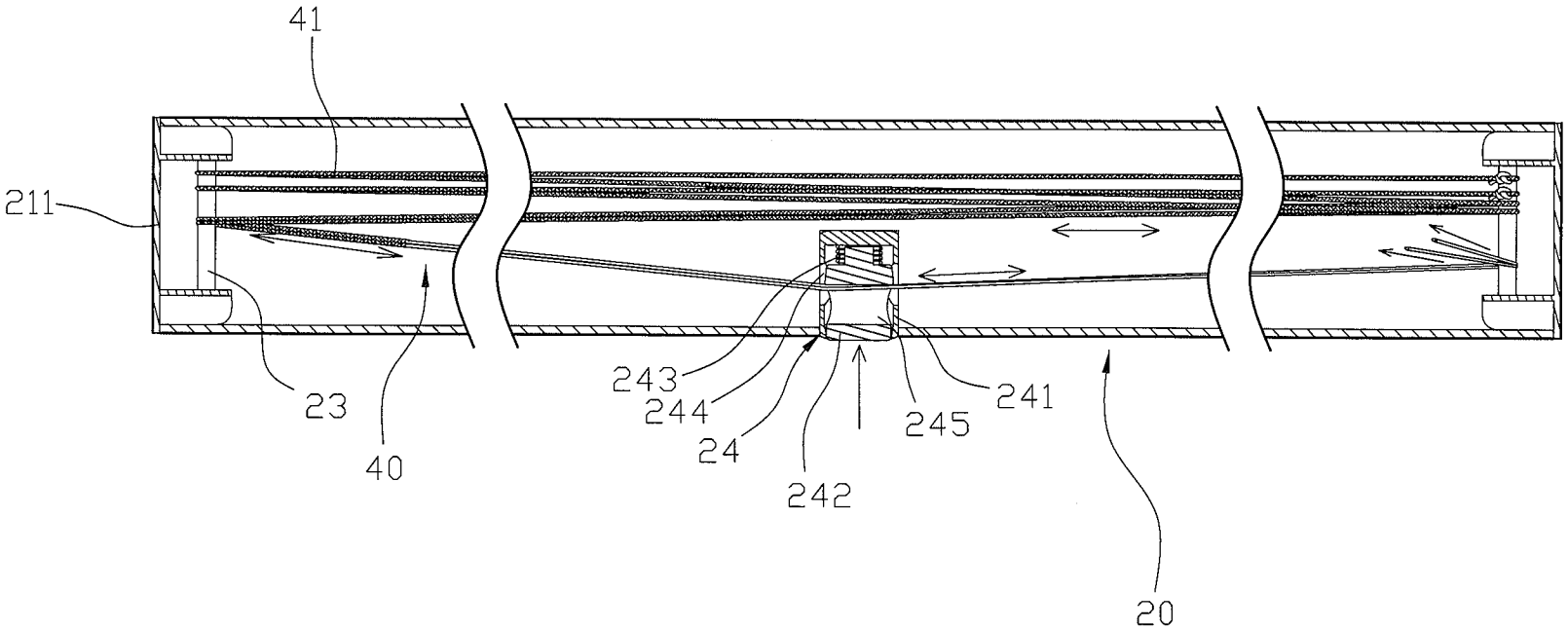
FIG. 7 is a schematic operational view of the window blind as shown in FIG. 4.
Figure 8:
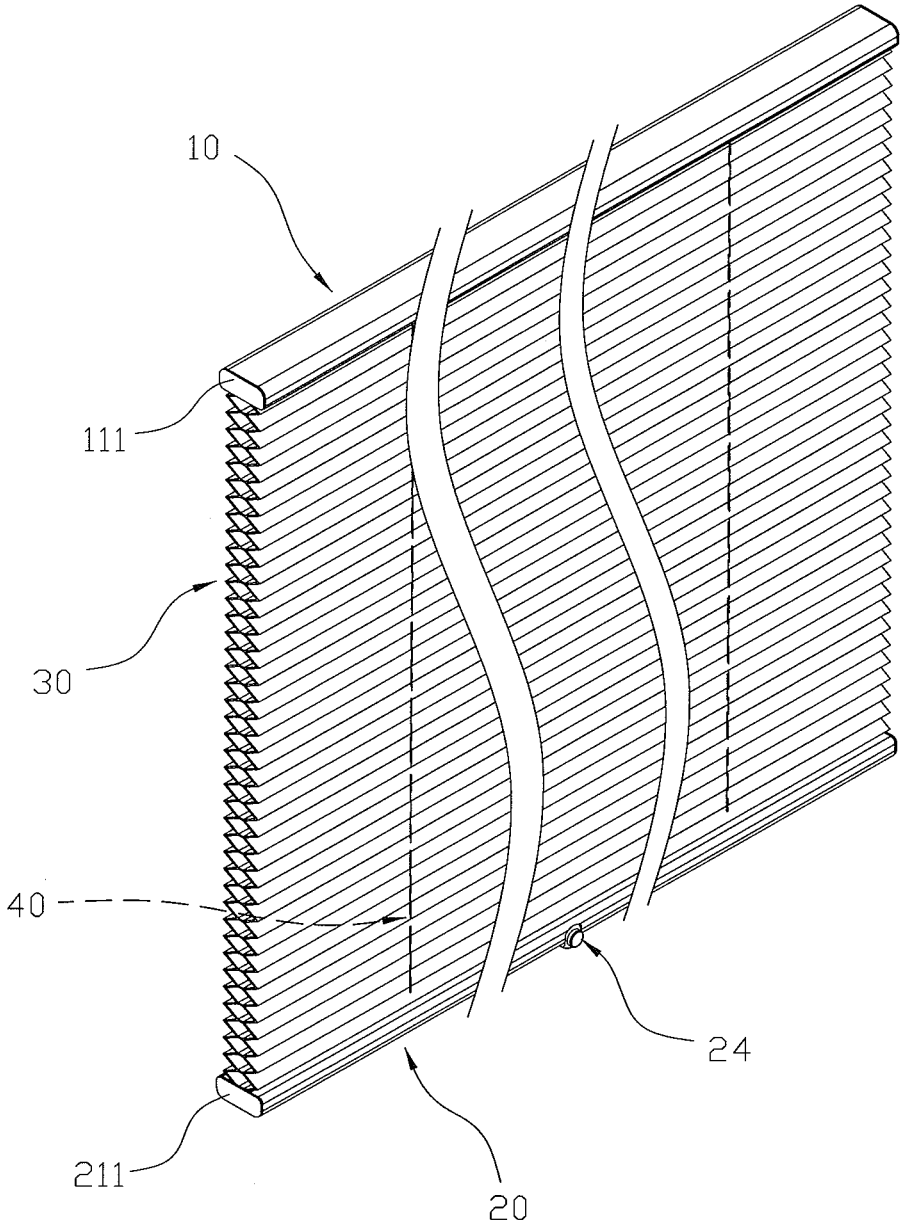
FIG. 8 is a schematic operational view of the window blind as shown in FIG. 6.

In operation, referring to FIGS. 6-8 with reference to FIGS. 1-5, the first passage 244 of the housing 241 misaligns with the second passage 245 of the push button 242 so that the connecting cord 40 is initially positioned by the housing 241 and the push button 242 at a normal state as shown in FIG. 4. At this time, the elastic section 41 of the connecting cord 40 is disposed at a retracted state. When the push button 242 is pressed to retract into the housing 241 as shown in FIG. 6, the first passage 244 of the housing 241 aligns with the second passage 245 of the push button 242 so that the connecting cord 40 is released from the housing 241 and the push button 242 as shown in FIG. 7 and can be drawn and extended freely. At this time, the elastic member 243 is compressed to store its restoring force. Thus, when the bottom rail 20 is pulled downward by the user, the shading unit 30 is driven by the bottom rail 20 to expand downward. In such a manner, the connecting cord 40 is pulled outward from the bottom rail 20 by drawing of the shading unit 30, and the elastic section 41 of the connecting cord 40 is extended elastically so as to correspond to the downward expansion of the shading unit 30. After the shading unit 30 is expanded downward to reach a determined position as shown in FIG. 8, the force applied on the push button 242 is removed, so that the push button 242 is pushed outward relative to the housing 241 by the restoring force of the elastic member 243 until the first passage 244 of the housing 241 misaligns with the second passage 245 of the push button 242. Thus, the connecting cord 40 is again positioned by the housing 241 and the push button 242 as shown in FIG. 4. At this time, the elastic section 41 of the connecting cord 40 is disposed at a stretched state. In such a manner, the shading unit 30 is disposed at an expanded state.

On the contrary, when the push button 242 is pressed to retract into the housing 241 as shown in FIG. 6, the first passage 244 of the housing 241 aligns with the second passage 245 of the push button 242 so that the connecting cord 40 is released from the housing 241 and the push button 242 as shown in FIG. 7 and can be drawn and extended freely. At this time, the elastic member 243 is compressed to store its restoring force. Thus, when the bottom rail 20 is pushed upward by the user, the shading unit 30 is driven by the bottom rail 20 to retract upward. In such a manner, the elastic section 41 of the connecting cord 40 is returned to the original retracted state by its elasticity, and the connecting cord 40 is retracted into the bottom rail 20 by the elastic force of the elastic section 41 so that the connecting cord 40 is gathered in the bottom rail 20 and is again wound around between the limit members 23. After the shading unit 30 is retracted upward to reach the folded position as shown in FIG. 1, the force applied on the push button 242 is removed, so that the push button 242 is pushed outward relative to the housing 241 by the restoring force of the elastic member 243 until the first passage 244 of the housing 241 misaligns with the second passage 245 of the push button 242. Thus, the connecting cord 40 is again positioned by the housing 241 and the push button 242 as shown in FIG. 4. In such a manner, the shading unit 30 is disposed at a folded state.

Figure 9:
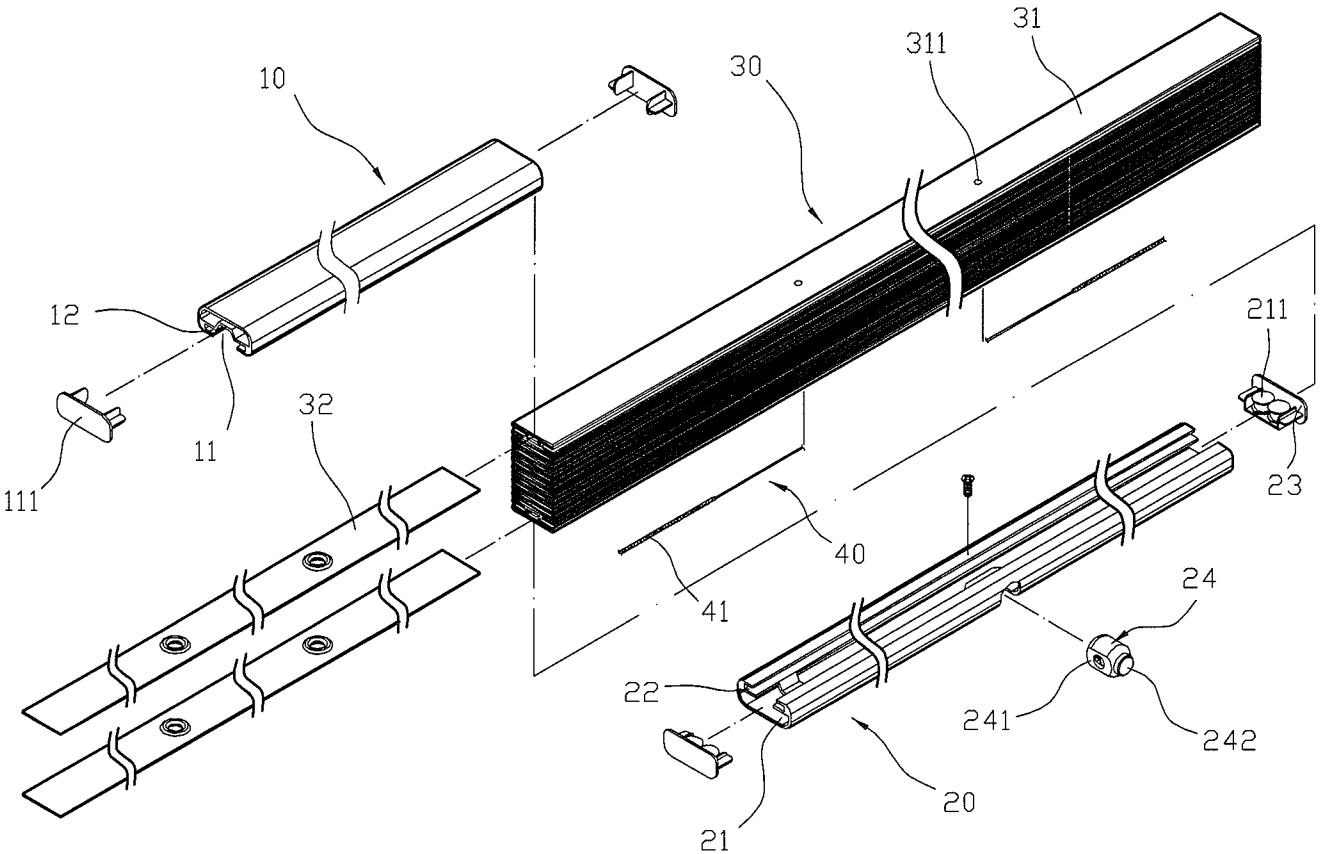
FIG. 9 is an exploded perspective assembly view of a window blind in accordance with another preferred embodiment of the present invention.
Figure 10:
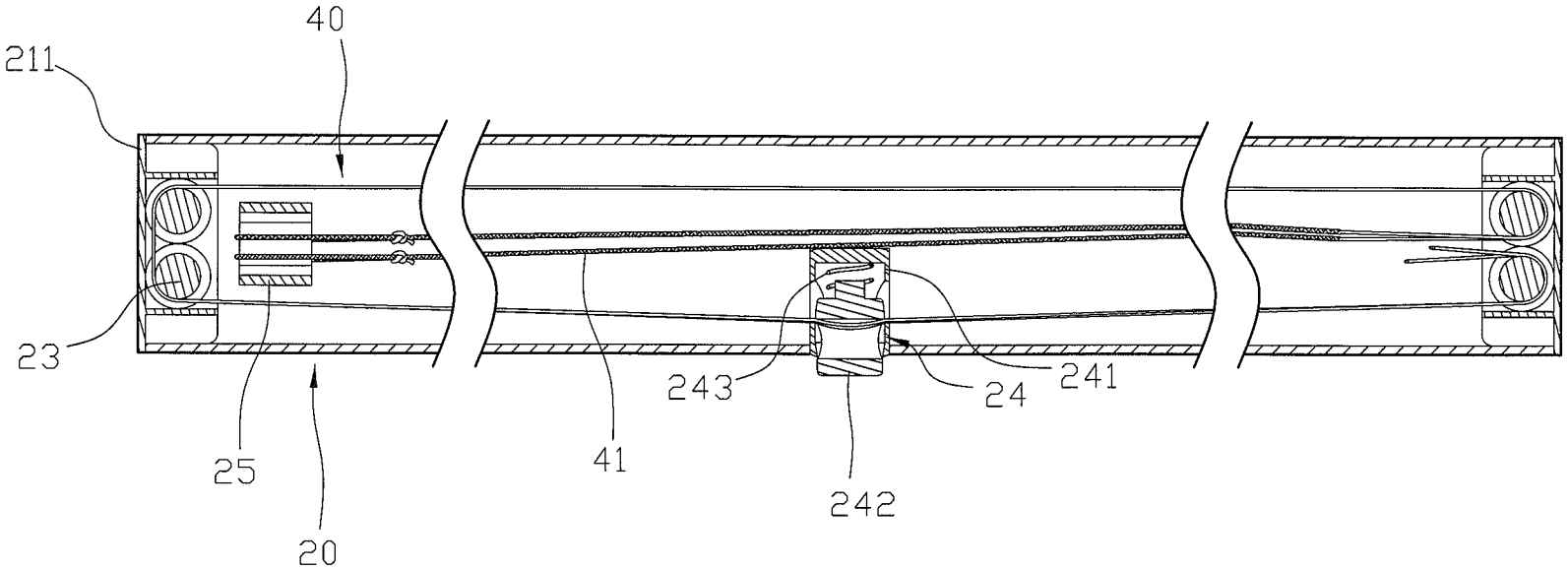
FIG. 10 is a top cross-sectional assembly view of the window blind as shown in FIG. 9.

Referring to FIGS. 9 and 10, the window blind comprises four limit members 23 located at four corners of the bottom rail 20. The second end cap 211 of the bottom rail 20 is combined with two of the limit members 23 integrally. The window blind further comprises a fixing member 25 mounted in the bottom rail 20 for mounting the connecting cord 40. The elastic section 41 of the connecting cord 40 is secured on the fixing member 25.

Accordingly, the window blind comprises the headrail 10, the bottom rail 20, the shading unit 30, the connecting cord 40 and the control unit 24 so that the window blind has a simplified construction, thereby decreasing the cost of fabrication. In addition, the window blind is assembled easily and quickly to facilitate a user assembling the window blind. Further, a user only needs to press the push button 242 so as to release the connecting cord 40 and to release the push button 242 so as to position the connecting cord 40 so that the window blind is locked and unlocked easily and quickly. Further, the elastic section 41 of the connecting cord 40 is extended or loosened when the shading unit 30 is expanded or retracted to prevent from producing noise during movement of the shading unit 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A window blind, comprising:

a retractable shading unit;

a headrail connected with an upper end of the shading unit;

a bottom rail connected with a lower end of the shading unit;

at least one connecting cord extended through the shading unit and having a first end secured on the headrail and a second end secured on the bottom rail;

wherein the connecting cord has a first elastic section and a second section, wherein:

in the first elastic section, the connecting cord has a length that is changed elastically to correspond to an expansion length of the shading unit, and in the second section, the connecting cord has a length that is substantially unchanged during operation of the shading unit;

a plurality of limit members mounted in the bottom rail; and a control unit mounted on the bottom rail;

wherein the headrail has a side provided with a first opening and has an interior provided with a first track;

the bottom rail has a side provided with a second opening and has an interior provided with a second track;

the shading unit includes a plurality of shading members located between the headrail and the bottom rail;

each of the shading members of the shading unit has a surface provided with a plurality of through holes;

the connecting cord is in turn extended through the headrail, the through holes of each of the shading members, the bottom rail and the control unit, and is wound around between the limit members;

the second end of the connecting cord is provided with an elastic section;

the elastic section of the connecting cord has a length that is changed elastically to correspond to an expansion length of the shading unit, wherein the control unit includes: a housing secured in the bottom rail; a push button movably mounted on the housing; and an elastic member mounted in the housing and biased between the housing and the push button; the housing of the control unit has a surface provided with a first passage to allow passage of the connecting cord; the push button of the control unit has a first end received in the housing and a second end protruding outward from the housing; the push button of the control unit has a surface provided with a second passage to allow passage of the connecting cord; the second passage of the push button is connected to the first passage of the housing; the elastic member of the control unit is biased between the housing and the first end of the push button to push the push button outward relative to the housing; the connecting cord is in turn extended through the first passage of the housing and the second passage of the push button; the connecting cord is clamped between the housing and the push button, and the connecting cord is released when the push button is pressed, wherein only the second section of the connecting cord passes through the control unit during operation of the shading unit.

2. The window blind of claim 1, wherein the headrail has two opposite first ends, each of which has a first opening, and a first pair of end caps are provided to seal each first opening; the bottom rail has two opposite second ends, each of which has a second opening, and a second pair of end caps are provided to seal each second opening.

3. The window blind of claim 2, wherein one second pair of end caps of the bottom rail is combined with one of the limit members integrally.

4. The window blind of claim 1, wherein the shading unit further includes: a first connecting plate mounted on a top one of the shading members; and a second connecting plate mounted on a bottom one of the shading members; the first connecting plate of the shading unit is mounted in the first track of the headrail; the second connecting plate of the shading unit is mounted in the second track of the bottom rail.

5. The window blind of claim 1, wherein the elastic section of the connecting cord has a distal portion secured on one of the limit members.

6. The window blind of claim 2, wherein the window blind comprises four limit members located at four corners of the bottom rail; one of the second pair of end caps of the bottom rail is combined with two of the limit members integrally; the window blind further comprises a fixing member mounted in the bottom rail for mounting the connecting cord; and the elastic section of the connecting cord is secured on the fixing member.

* * * * *